US005754090A

United States Patent [19]

Arensmeier

[11] Patent Number: 5,754,090

[45] Date of Patent: May 19, 1998

[54] THERMOSTAT HAVING A TEMPERATURE SENSING ELEMENT WHICH INCLUDES A MEMBER HAVING A NEGATIVE COEFFICIENT OF THERMAL EXPANSION

[75] Inventor: Jeffrey N. Arensmeier, St. Louis, Mo.

[73] Assignee: Emerson Electric Co., St. Louis, Mo.

[21] Appl. No.: 684,144

[22] Filed: Jul. 19, 1996

[51] Int. Cl.[6] ..... H01H 37/48

[52] U.S. Cl. ..... 337/394; 337/123; 337/382; 219/449

[58] Field of Search ..... 337/123, 382, 337/392, 393, 394; 219/449

[56] References Cited

U.S. PATENT DOCUMENTS

| | | | |
|---|---|---|---|
| 2,856,489 | 8/1958 | Bletz | 337/394 X |
| 3,447,746 | 6/1969 | Visos | 236/21 |
| 3,691,501 | 9/1972 | Katchka et al. | 337/393 |
| 5,294,907 | 3/1994 | Katchka | 337/394 |

*Primary Examiner*—Leo P. Picard
*Assistant Examiner*—Jayprakash N. Gandhi
*Attorney, Agent, or Firm*—Paul A. Becker, Sr.

[57] ABSTRACT

A thermostat includes a valve for controlling gas flow, an actuator for controlling operation of the valve, and a temperature sensing element. The temperature sensing element comprises two members, one of which is made of a material having a positive coefficient of thermal expansion and the other of which is made of a material having a negative coefficient of thermal expansion. Each member effects movement of the actuator in a first direction upon sensing a decrease in temperature to effect opening of the valve and in a second direction upon sensing an increase in temperature to effect closing of the valve.

6 Claims, 1 Drawing Sheet

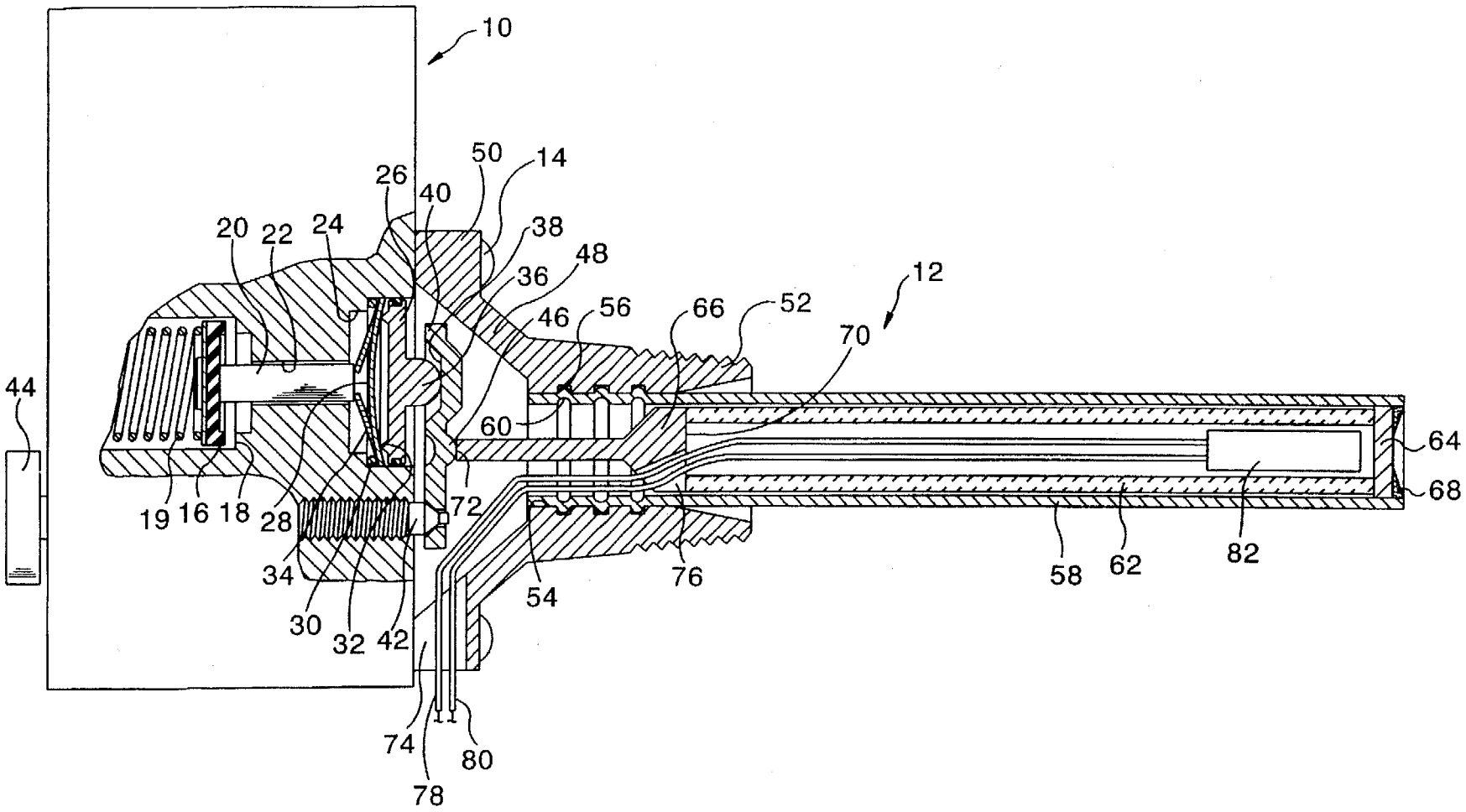
10
12
14
16
18
19
20
22
24
26
28
30
32
34
36
38
40
42
44
46
48
50
52
54
56
58
60
62
64
66
68
70
72
74
76
78
80
82

THERMOSTAT HAVING A TEMPERATURE SENSING ELEMENT WHICH INCLUDES A MEMBER HAVING A NEGATIVE COEFFICIENT OF THERMAL EXPANSION

BACKGROUND OF THE INVENTION

This invention relates to thermostats utilized in water heaters, and particularly to an improved construction of the temperature sensing element therein.

Typically the thermostat in domestic gas-fired water heaters utilizes a so-called "rod and tube" sensing element connected to the thermostat housing. Such sensing element typically comprises an invar rod and a copper tube. The copper tube has a relatively high coefficient of thermal expansion, and the invar rod has a relatively low coefficient. One end of the invar rod is connected to the copper tube. The other end of the invar rod is moved toward or away from the thermostat housing primarily in response to the expansion and contraction of the copper tube as the copper tube responds to the changes in water temperature. The invar rod also expands and contracts in response to the changes in water temperature, but to a lesser degree because of its low coefficient. However, the expansion and contraction of the invar rod causes movement of its free end in a direction opposite to that caused by the copper tube. The resulting movement toward and away from the thermostat housing is transmitted to valve actuating means in the thermostat housing to effect opening and closing of a gas valve member in the thermostat which controls the flow of gas to the burner. While such prior art thermostats are generally satisfactory, the temperature differential, which is the difference in water temperature between the temperatures at which the burner turns on and off, is greater than desired.

SUMMARY OF THE INVENTION

An object of this invention is to provide a generally new and improved thermostat having a temperature sensing element which enables a lower temperature differential.

In the preferred embodiment, a thermostat comprises a temperature sensing element comprising a first member having a positive coefficient of thermal expansion and a second member having a negative coefficient of thermal expansion. Each member effects movement of a valve actuator in a first direction upon sensing a decrease in temperature to effect opening of the valve, and in a second direction upon sensing an increase in temperature to effect closing of the valve. Such construction results in a temperature differential that is considerably less than that obtained in the conventional rod and tube construction.

The above mentioned and other objects and features of the present invention will become apparent from the following description when read in conjunction with the accompanying drawings.

BRIEF DESCRIPTION OF THE DRAWINGS

The single FIGURE in the drawings is a partial cross-sectional view of the thermostat constructed in accordance with the present invention.

DESCRIPTION OF THE PREFERRED EMBODIMENT

Referring to the drawings, the thermostat of this invention comprises a housing indicated generally at 10 and a temperature sensing element indicated generally at 12. Sensing element 12 is connected to housing 10 by a plurality of screws 14.

Housing 10 includes a valve 16 biased towards a valve seat 18 by a spring 19. A valve stem 20 is connected at one end to valve 16. The other end of stem 20 extends through a bore 22 into a circular cavity 24. Mounted within cavity 24 are a rigid disc 26 and a clicker spring 28. Clicker spring 28 has a normal free-form position in which it is concave with respect to stem 20. The clicker spring 28 is positioned between a wire loop 30, which engages the clicker spring 28 on its normally-concave side near its peripheral edge, and an annular knife-edge 32 of slightly smaller diameter formed on the side of disc 26 which faces spring 28. A slight movement of disc 26 in the direction of clicker spring 28 causes clicker spring 28 to pass through a planar shape, with a snap action, to an opposite form wherein it is convex with respect to stem 20. When clicker spring 28 passes through the planar shape, central leg portions 34 thereof engage stem 20, as shown in the drawing, causing valve 16 to be lifted off valve seat 18 against the bias of spring 19. Gas can then flow from a source (not shown), past valve seat 18 and to a gas burner (not shown).

The side of disc 26 which faces sensing element 12 is provided with a hemispherical boss 36 which cooperates with a recess 38 in one end of a lever 40. Lever 40 is pivoted at its other end on the tip of an adjusting screw 42. Screw 42 is adjustable by means of a knob 44. Lever 40 is also provided with an intermediate hemispherical boss 46.

The construction of housing 10 described above is well known in the art and it is believed that it has been described herein in sufficient detail for purposes of the present invention. If more detail is desired, reference may be had to Visos, U.S. Pat. No. 3,447,746, this patent hereby being incorporated into this disclosure by this reference.

Temperature sensing element 12 includes a brass flange 48 having one end 50 thereof attached by screws 14 to housing 10 and the other end 52 being externally threaded. An internal bore 54 of flange 48 is provided with a plurality of shallow grooves 56. One end of a copper tube 58 is secured inside internal bore 54 of flange 48 by a swaged joint obtained by forcing those portions of copper tube 58 adjacent grooves 56 into the grooves 56 thereby producing peripheral projections 60 on copper tube 58 which cooperate with grooves 56 to provide a rigid and water-sealing connection of copper tube 58 to flange 48. Copper tube 58 has a positive coefficient of thermal expansion.

Slidably mounted within copper tube 58 is a tube 62 made of a ceramic material having a negative coefficient of thermal expansion. Tube 62 is sandwiched between a plug 64 at one end and an actuator 66 at its other end. Plug 64 is made of a metal, such as brass, having a desired level of heat conductivity. Plug 64 is secured inside copper tube 58 in a press-fit manner so as to prevent plug 64 from moving relative to copper tube 58 when force is applied to plug 64 by tube 62. Solder is applied at 68 to ensure that water will not enter into copper tube 58. Actuator 66 is made of a metal, preferably steel. Actuator 66 has a large diameter end 70 which abuts against one end of tube 62 and a small diameter end 72 which abuts against boss 46 of lever 40.

Passing through a slot 74 in flange 48 and a slot 76 in actuator 66 are two leads 78 and 80 which connect external circuitry (not shown) to a high-temperature limit switch 82 which is located inside of tube 62. If, for any reason, the sensed water temperature should rise above a predetermined value, switch 82 will respond to such temperature by interrupting the external circuitry and thereby effecting the closing of a safety valve (not shown) in housing 10 upstream from and in series flow relationship with the gas flow controlled by valve 16.

In operation, the thermostat of this invention is assembled to a water heater (not shown) in a well known arrangement wherein flange 48 is threadedly connected to a threaded nipple (not shown) in the water heater so that sensing element 12 extends through a central opening of the threaded nipple and is thereby immersed in the water of the water heater. A desired set point temperature is selected by knob 44 which is connected to adjusting screw 42 which, in turn, adjusts the pivot point of lever 40. As the water temperature drops, copper tube 58 contracts and ceramic tube 62 expands. Because ceramic tube 62 is sandwiched between plug 64 and actuator 66 and because plug 64 is rigidly connected to copper tube 58, contraction of copper tube 58 and expansion of ceramic tube 62 cause actuator 66 to be moved to the left as viewed in the drawing, thereby causing movement of lever 40 around its pivot point on the end of adjusting screw 42 which, in turn, causes movement of disc 26. Upon sufficient movement to the left, actuator 66 effects sufficient movement of lever 40 and disc 26 to cause clicker spring 28 to snap through its planar shape and effect opening of valve 16. With valve 16 open, gas then flows to the burner to effect heating of the water.

As the water temperature subsequently rises, copper tube 58 expands and ceramic tube 62 contracts, enabling actuator 66 to be moved to the right by the biasing forces of clicker-spring 28 and spring 19. Upon sufficient movement to the right, actuator 66 enables sufficient movement of lever 40 and disc 26 to enable clicker spring 28 to snap through its planer shape and effect closing of valve 16. With valve 16 closed, gas flow to the burner is shut off.

The temperature differential of the thermostat of this invention is considerably less than the differential of a typical prior art thermostat utilizing the conventional invar rod and copper tube construction of the sensing element. For example, a typical differential of such a prior art thermostat is approximately 22° F.; the differential of a thermostat of this invention was found to be approximately 14° F. It is believed that this reduction in differential is due to the utilization of a temperature sensing member having a negative coefficient of thermal expansion. Specifically, in the conventional rod and tube construction, both the copper tube and the invar rod have positive coefficients of thermal expansion. While the coefficient of the invar rod is quite small, approximately one-tenth of the coefficient of copper, the invar rod causes movement of the switch actuating means in a direction opposite to that provided by the copper tube, causing the temperature differential to be greater than it would be due solely to the movement of the switch actuating means caused by the copper tube. In the thermostat of the present invention, ceramic tube 62, having a negative coefficient of thermal expansion, causes movement of actuator 66 in the same direction as that provided by copper tube 58, causing the differential to be less than it would be due solely to the movement of actuator 66 caused by copper tube 58.

In the preferred embodiment, tube 62 is made of a ceramic having a composition of $LiAlSiO_4$ (β-eucryptite) having a negative coefficient of thermal expansion of approximately 0.0000042 in/in/°F.(inch per inch per degree Fahrenheit.) In a working embodiment, ceramic tube 62 is approximately four inches long with an outside diameter of 0.540 inches and an inside diameter of 0.390 inches, and copper tube 58 is approximately five inches long with an outside diameter of 0.625 inches and an inside diameter of 0.561 inches. Copper tube 58 has a positive coefficient of thermal expansion of approximately 0.000010 in/in/°F.

It is to be understood that other ceramic materials can possibly be used for tube 62. Examples of such other ceramic materials include $LiAlSi_2O_6$ (β-spodumene) and zirconium tungstinate. It is to be further understood that materials other than ceramic can possibly be used if they have a negative coefficient of thermal expansion and if they can satisfy the stiffness and stability requirements of tube 62. An example of such other materials is a carbon filled polyester liquid crystal polymer.

While a preferred embodiment of the present invention has been illustrated and described in detail in the drawings and foregoing description, it will be recognized that many changes and modifications will occur to those skills in the art. It is therefore intended, by the appended claims, to cover any such changes and modifications as fall within the true spirit and scope of the invention.

I claim:

1. In a thermostat for controlling temperature of water in a gas-fired water heater, a valve for controlling flow of gas to a burner in the water heater;

an actuator for controlling operation of said valve;

a flange for connecting the thermostat to said water heater;

a first temperature responsive member being tubular and made of a material having a positive coefficient of thermal expansion having an open end connected to an internal bore of said flange and having a closed end extending into said water of said water heater; and a second temperature responsive member made of a material having a negative coefficient of thermal expansion slidably mounted within said first temperature responsive member having a first end in contact with said closed end of said first temperature responsive member and having a second end in contact with said actuator.

2. The thermostat claimed in claim 1 wherein said material of said first temperature responsive member comprises copper and said material of said second temperature responsive member comprises ceramic.

3. The thermostat claimed in claim 2 wherein said ceramic has a composition of $LiAlSiO_4$.

4. The thermostat claimed in claim 1 wherein said connection of said open end of said first temperature responsive member to said internal bore of said flange comprises a swaged joint.

5. The thermostat claimed in claim 1 wherein said closed end of said first temperature responsive member comprises a plug which is press-fitted into said first temperature responsive member.

6. The thermostat claimed in claim 1 wherein said second temperature responsive member is tubular and wherein the thermostat further includes a limit switch located inside of said second temperature responsive member.

* * * * *